United States Patent [19]

Prescott

[11] Patent Number: 4,768,674

[45] Date of Patent: Sep. 6, 1988

[54] BAFFLE FOR FLUID CONTAINERS

[75] Inventor: Greg W. Prescott, Huson, Mont.

[73] Assignee: SIP Development Corporation, Seattle, Wash.

[21] Appl. No.: 71,658

[22] Filed: Jul. 7, 1987

[51] Int. Cl.[4] ..... A47G 19/22

[52] U.S. Cl. ..... 220/90.4; 220/22; 220/21

[58] Field of Search ..... 220/90.4, 22, 21

[56] References Cited

U.S. PATENT DOCUMENTS

| | | | |
|---|---|---|---|
| 2,362,354 | 11/1944 | Clovis | 220/90.4 |
| 2,428,056 | 9/1947 | Wachsman | 220/90.4 |
| 2,748,946 | 6/1956 | Smith | 220/90.4 |
| 3,313,447 | 4/1967 | Spencer | 220/90.4 |
| 3,360,160 | 12/1967 | Spencer | 220/90.4 |
| 3,379,338 | 4/1968 | Marks et al. | 220/90.4 |
| 3,400,855 | 9/1968 | Alexander | 220/90.4 |
| 3,549,044 | 12/1970 | Lerner | 220/90.4 |
| 3,556,341 | 1/1971 | Rains | 220/90.4 |
| 3,689,051 | 9/1972 | Miller | 220/22 |
| 3,804,292 | 4/1974 | Chiti | 220/22 |
| 3,940,012 | 2/1976 | Addington | 220/90.4 |
| 3,979,005 | 9/1976 | Robinson et al. | 220/22 |

FOREIGN PATENT DOCUMENTS

| | | |
|---|---|---|
| 554823 | 5/1922 | France . |
| 88979 | 8/1958 | Netherlands . |

*Primary Examiner*—Joseph Man-Fu Moy

*Attorney, Agent, or Firm*—Wells, St. John & Roberts

[57] ABSTRACT

A baffle is set forth for use within fluid containers or vessels. The baffle comprises a ribbon of resilient material that is formed in a pleated configuration that may be compressed circumferentially at a top end edge, a bottom end edge, or at both ends to facilitate insertion within a wide variety of vessel sizes and shapes. The ribbon of material is resilient and of sufficient rigidity to maintain a number of axial cells throughout compression of the ribbon. The ribbon and cells thereby when placed adjacent the surface of the liquid within the container act to minimize turbulence within the container and thereby minimize spillage when the container is jolted. The baffle inserts are shaped to be nested, one in another, for storage and ultimate dispensing.

24 Claims, 6 Drawing Sheets

BAFFLE FOR FLUID CONTAINERS

TECHNICAL FIELD

The present invention relates generally to structures for use in fluid containing vessels to minimize spill and splash resulting from fluid turbulence.

BACKGROUND OF THE INVENTION

A transported vessel, such as a coffee cup, represents a substantial safety hazard, especially if being carried in a vehicle. Jostling or bumps along the roadway can cause spillage of the hot liquid and has often been the cause of serious vehicular accidents, not to mention the painful burns and damage to personal property caused by the spill.

In response to the above and similar problems, a variety of anti-spill or anti-slosh devices have been developed for use with drinking vessels. Prior forms of baffle configurations typically mechanically deflect and dampen surface fluid motion. Such devices have been either mechanically secured to or integral with a drinking vessel.

Other devices do not attempt to baffle or dampen surface liquid movement, but instead attempt to close off the vessel and allow only a minimal passageway for the fluids. These devices are undesirable in that they usually cover the liquid from view and undesirably restrict fluid flow. They also prevent release of aroma from the vessel and therefore inhibit the sense of smell and taste.

Many baffle insert arrangements in the past have tended to be of a rigid nature and were not readily adaptable to containers of various shapes and sizes. Existing baffles have also tended to resist proper cleaning due to their typical complex surface structure and rigidity. Many consumers and commercial establishments have therefore avoided using baffle inserts due to their limited effectiveness and inability of the baffles to adapt to various size and shape vessels.

Another difficulty with known forms of baffle inserts or spill preventing devices is that they lack considerably in aesthetic appeal. No one wants to drink from a cup with an unappealing insert resting along the surface of their drink.

The present invention overcomes the deficiencies indicated above by providing a baffle that is extremely effective in preventing spillage from vessels and which is easily adapted to a wide variety of vessel sizes and shapes. Another distinct advantage of the present invention is that it may be produced in any of a variety of aesthetically appealing configurations.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

Figure 1:
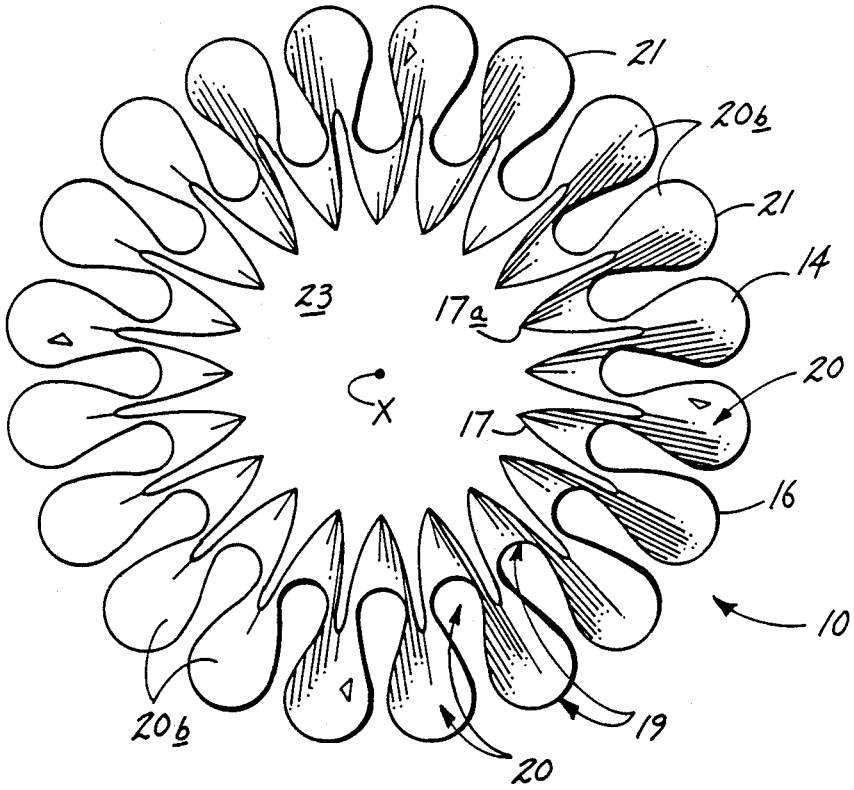
FIG. 1 is a top plan view of first preferred form of the present invention in an normal relaxed, memory form.

The following disclosure of is submitted in compliance with the constitutional purpose of the Patent Laws "to promote the progress of science and useful arts" (Article 1, Section 8).

Several forms of the present baffle are illustrated in the drawings to exemplify the wide variation of different configurations in which the present baffle may be formed. A first preferred form is a baffle insert 10 as illustrated in FIGS. 1 through 9 while alternate forms are disclosed in FIGS. 10 through 14. Baffle 10 may also be formed as a part of a vessel 11 or as an attachment thereto. Preferably, however, the present baffle is produced as an insert for removable attachment within a vessel 11.

Generally, the present baffle 10 is intended for use within a variety of vessel forms and sizes, several of which are shown in the accompanying drawings. The several vessel forms are shown to exemplify the adaptability of the present invention as a baffle insert. A single size baffle insert 10 of the present invention may be placed within a wide variety of vessels of different sizes and different internal configurations. This is a very important advantage of the present invention. Features that enable such adaptability will become apparent below.

The present baffle insert 10 is formed of a resilient material capable of being formed into the exemplary configurations shown, or other configurations that may be obviously envisioned from the teaching of this disclosure. A preferred material is a polycarbonate sheet material currently sold under the trademark "Lexan". Other materials, for example, polyethylene, polypropylene or polystyrene may also be utilized as appropriate materials for construction of the present invention.

It is further conceivable that materials other than plastics could also be utilized for construction of the present invention. Fiber materials, paper products biodegradable or otherwise could be used, for example, where disposable usage is desired or where it may be desired to impregnate porous baffle materials with coloring, flavoring, etc. intended to interact with liquid in the associated vessel.

The material selected must include resilient properties. It should retain a "memory" that will facilitate initial forming to a prescribed shape and that will substantially regain the prescribed shape following deflection of the material. The material should also be capable of use in a variety of liquids for human consumption. It may otherwise be transparent, translucent, opaque or have any desired coloration for aesthetic purposes.

As indicated above, a preferred material is the polycarbonate "Lexan" which may elected for extended, multi-use situations and which has the desired resilient properties in sheet or ribbon form and typically desirable non-porous, non-flavoring characteristics for standard use. The material also has sufficient rigidity due to its inherent mechanical properties and its thickness dimension in ribbon form (advantageously between 3 and 10 mil.) to substantially resiliently maintain a prescribed form.

The present insert 10 may be produced from the selected material by a number of different manufacturing techniques. The insert may be heat-formed into the desired configuration from cut, stamped or patterned sheets of the selected material. It could also be heat formed, pressed, stamped or otherwise formed from partially preformed or cylindrical extruded tubular material. It could also conceivably be injection molded.

The baffle insert 10 is preferably formed of a ribbon 14 of the selected resilient material. The ribbon 14 is preferably continuous, as a tubular annulus, formed about a central axis "X" as identified in FIGS. 1 and 2. However, it is also quite conceivable that the present invention could be produced by a finite length ribbon, formed into a prescribed configuration for insertion within an appropriate vessel.

Figure 3:
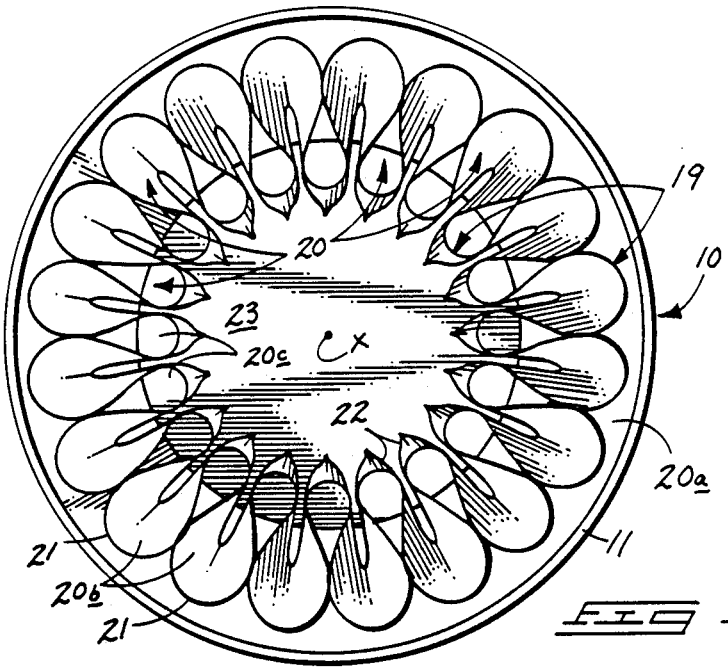
FIG. 3 is a top plan view of the baffle insert of FIG. 1 contracted to a large usable compression size configuration in a large size cup.
Figure 6:
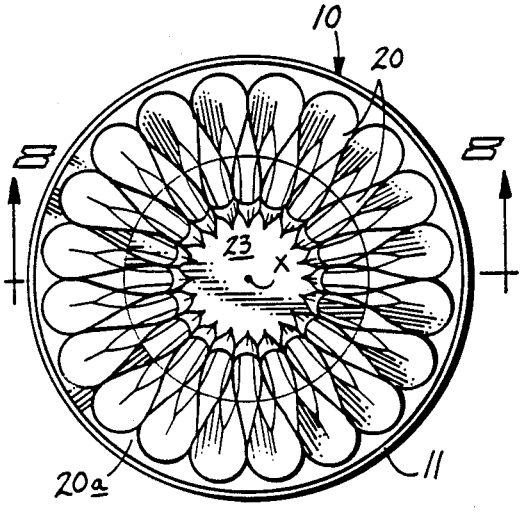
FIG. 6 is a top plan view of the baffle insert form shown in FIGS. 1 and 3 but with the baffle insert compressed to a substantially small usable compression size configuration in a small cup.
Figure 7:
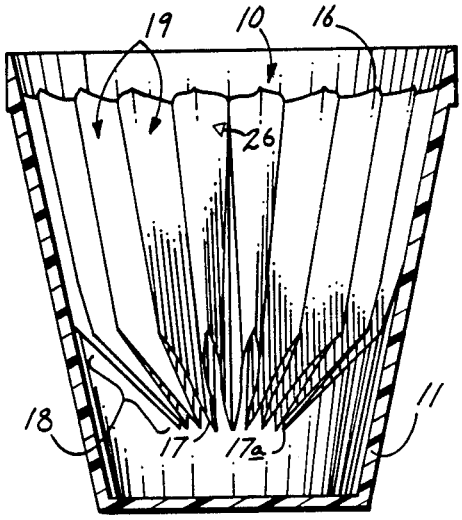
FIG. 7 is a sectional view through a vessel illustrating the baffle insert compressed to a small size configuration.

The ribbon 14 thus formed includes a top end edge 16 and a bottom end edge 17. Both edges 16, 17 are formed in a prescribed configuration about the central axis X—X. In the first preferred form, the prescribed configuration is petaloid as shown in FIGS. 1, 3, and 6.

The baffle insert form illustrated in FIGS. 1 through 9 includes a tapered section 18 along the bottom end edge 17. This taper decreases radially from outwardly facing surfaces of the baffle insert to a substantially pointed bottom end 17*a*. Tapered section 18 is provided to adapt the present insert for easy placement within associated vessels and when so inserted, to define an annular open chamber adjacent the bottom of the vessel for free circulation of liquids therein.

Figure 4:
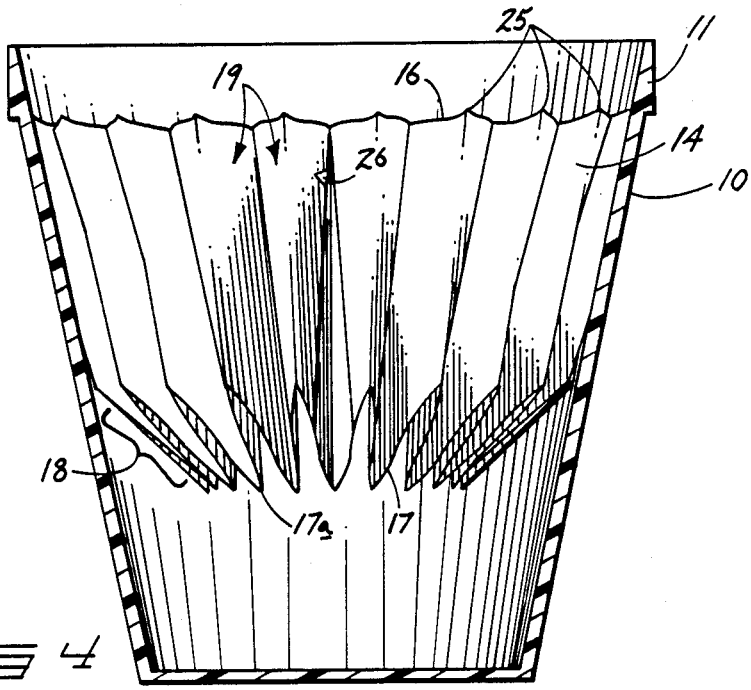
FIG. 4 is a side elevation section taken through the cup in FIG. 3 showing placement of a baffle insert therein.
Figure 9:
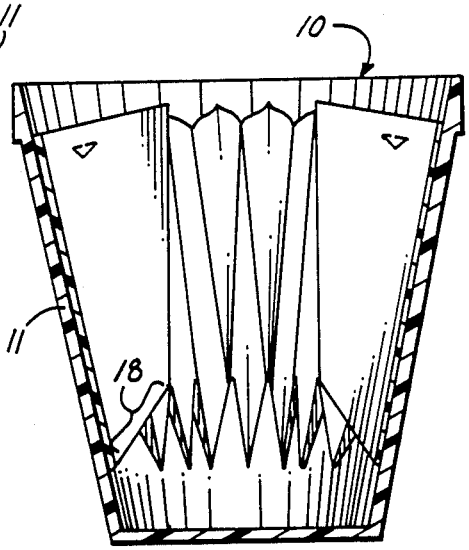
FIG. 9 is a view similar to FIG. 8 only showing the baffle insert in an reversed configuration.

The ribbon 14, being formed of resilient material, is reversible to the configuration shown in FIG. 9. In this reversed configuration, the tapered section 18 forms a downwardly facing concave surface. Such a concave surface may be desirable in certain situations as where ice is used in a drink and it is desired to keep the ice confined toward the bottom of the vessel. The inclined surfaces 18 in the FIG. 9 configuration will be cammed outward by the buoyant ice cubes against the vessel walls. When the tapered section 18 faces outward as shown in FIG. 4, the buoyant cubes may act against the tapered surface to radially compress the baffle member and lift it upwardly out of the vessel.

Figure 8:
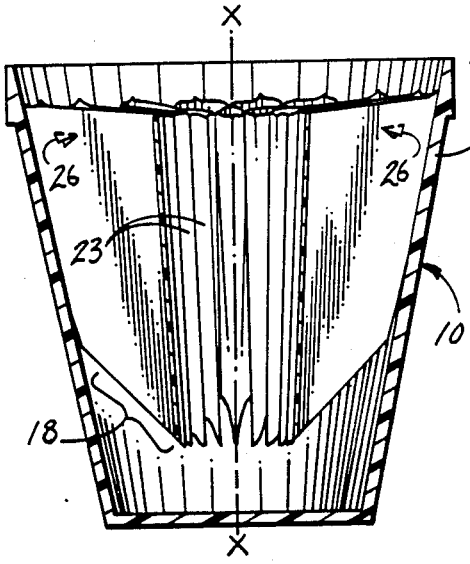
FIG. 8 is a sectional view taken substantially along line 8—8 in FIG. 6.

The top and edge 16 of the baffle insert is advantageously axially concave as may be noted in FIG. 8. The concave shape is both aesthetically appealing and functional, allowing "nose space" within the vessel when it is tipped up for drinking.

A very important feature of the present invention resides in a plurality of axial pleats 19 formed in the ribbon between the top and bottom end edges 16, 17 to produce a prescribed transverse cross-sectional configuration in relation to the central axis. The version shown in FIGS. 1 through 9 show the ribbon in the aesthetically pleasing substantially petaloid configuration. A sampling of other aesthetically pleasant yet functional configurations including symmetrical or random curvilinear, geometric, and combined curvilinear-geometric configurations are shown in FIGS. 10 through 14.

Regardless of the prescribed cross-sectional configuration, the pleats 19 are folded in a substantially ruffled configuration in order to produce a plurality of axially oriented open ended fluid receiving cells 20. These cells 20 are produced not only by the ribbon itself, but may be also produced as shown at 20*a* between contacting surfaces of the ribbon and adjacent walls of the vessel as shown in FIGS. 3 and 6. These discreet, axially open cells serve to control movement of the liquid within the vessel and prevent unintentional spillage.

Figure 10:
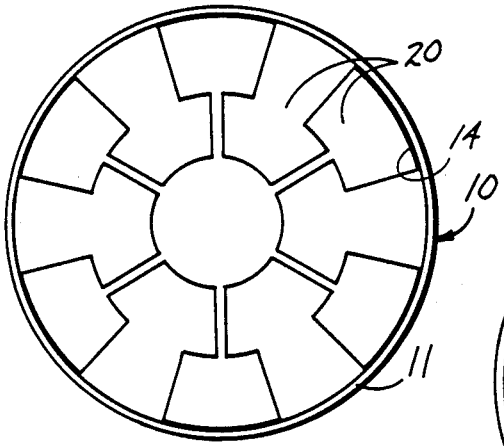
FIGS. 10 through 14 are illustrative of alternative cross-sectional baffle insert.
Figure 11:
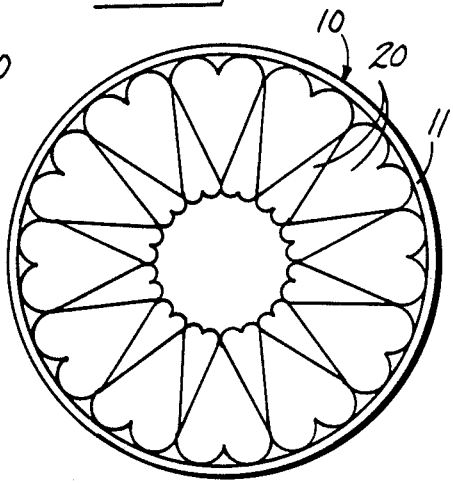
Figure 12:
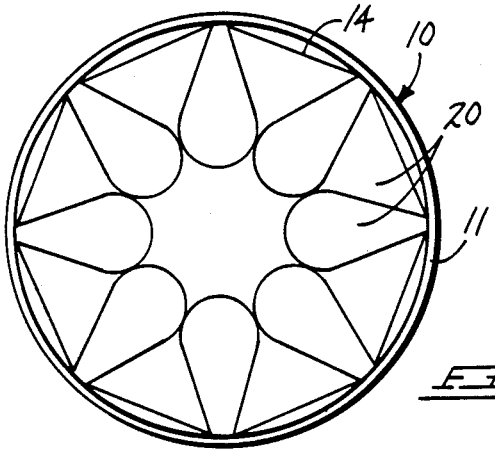

In the first preferred, petaloid configuration, and perhaps in other configurations as exemplified in FIGS. 10 through 12. Two concentric sets of cells are formed. An outward set 20*b* is defined partially by outwardly positioned curved sections 21 of the pleats. An inward concentric set of cells 20*c* is formed by radially inward positioned sections 22 of the pleats. The cells 20*b* normally open inwardly into a central axial opening 23 when the insert is in its relaxed, memory state. They progressively close circumferentially, becoming independent from the central opening 23 as the insert is circumferentially compressed. The inner set of cells 20*c* normally open outwardly. They will also progressively close circumferentially as the insert is circumferentially compressed, therefore becoming independent of the cells 20*a* formed by the surfaces 21 and adjacent surfaces of the vessel 11.

The opening 23 exemplified in FIG. 8 extends axially from the top end edge 16 of the ribbon through the bottom end edge 17. Opening 23 provides free access to the contents at the bottom of the vessel and enables circumferential contraction of the baffle. Ice may be added through the central opening 23. Obviously other ingredients, such as sugar, cream, etc., may also be added.

Figure 13:
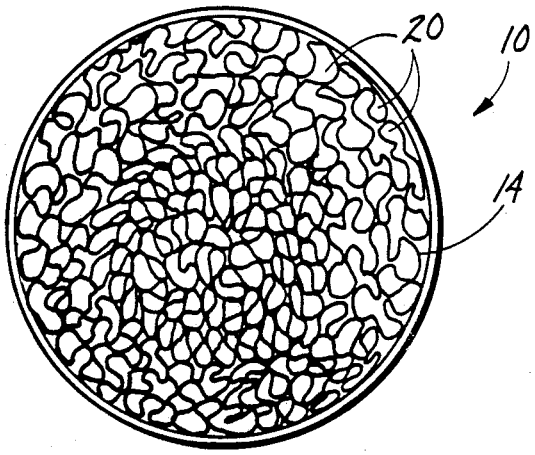
Figure 14:
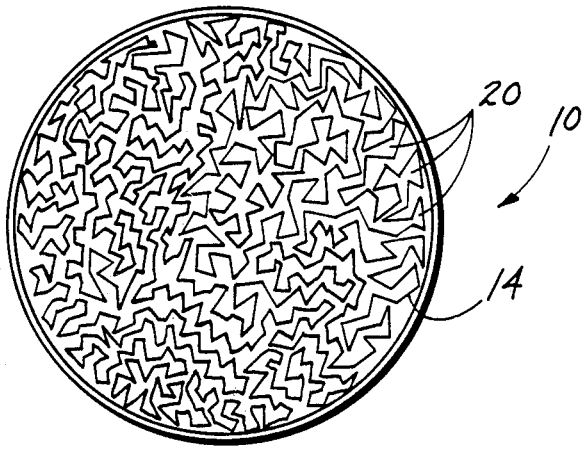

In alternate versions, the central opening may be eliminated as shown in the cross-sectional configurations indicated by FIGS. 13 and 14. With such configurations, however, any mixing or adding of components to the liquid contents of the vessel would be desirable or required prior to installation of the baffle insert.

Figure 2:
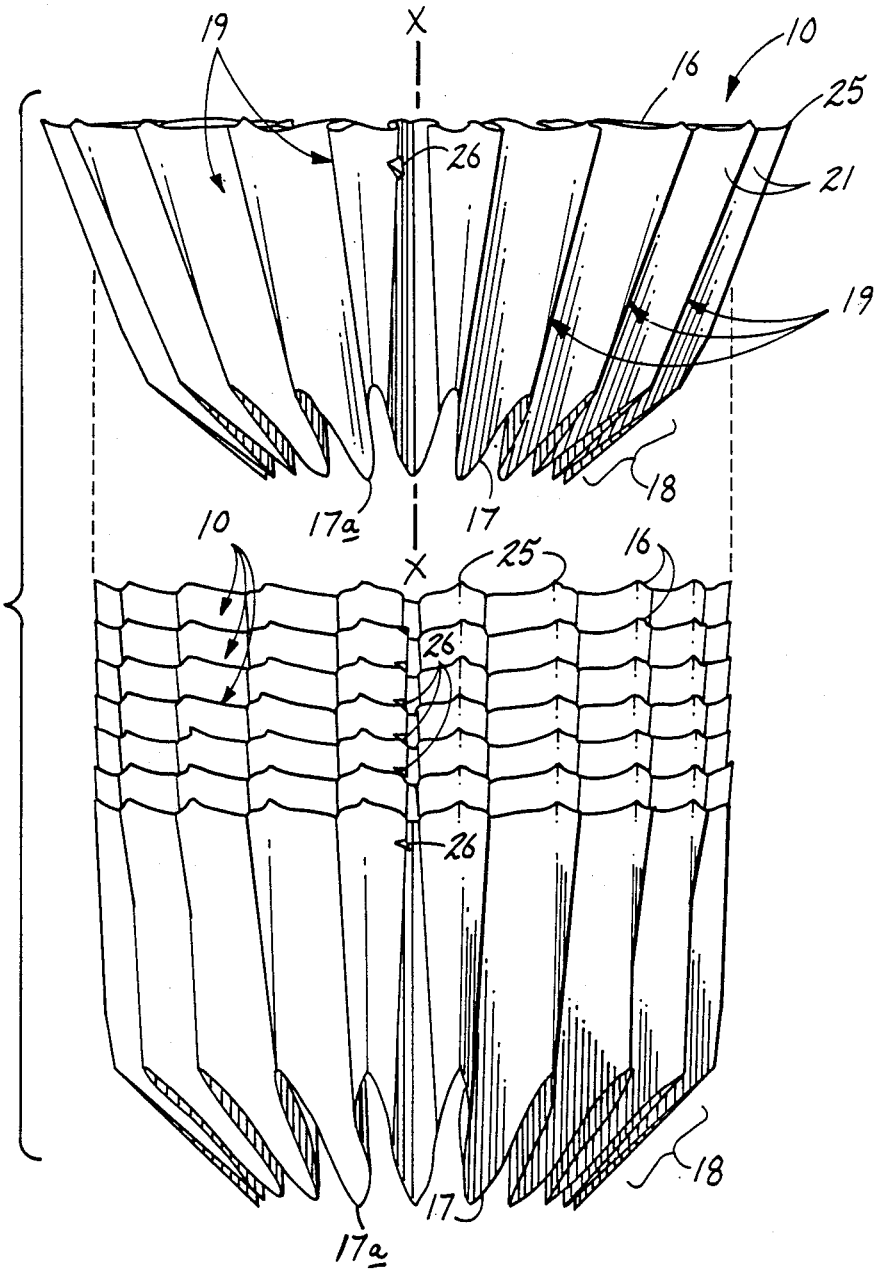
FIG. 2 is a side elevation view of a nested stack of the present baffle inserts, with one of the baffle inserts shown spaced above the stack.

As illustrated by FIGS. 1 and 2, the pleats 19 themselves taper circumferentially, making a gradual transition from smooth, curved folds at the top end edge 16 to linear, sharply folded pleats along the bottom end edge 17 at section 18. This form evolved from experience as the best memory or form set to optimize proper tapering of interior and exterior cells 20. This particular construction has been found to optimize the degree of cell closure corresponding with compression of the insert to accommodate the broadest range of vessel sizes and shaped possible.

Figure 5:
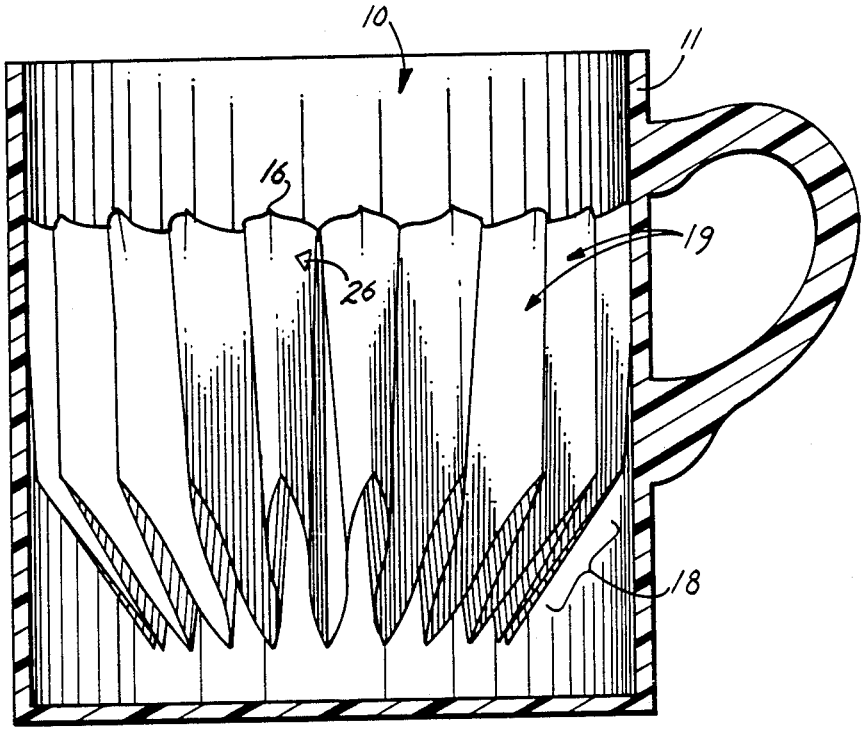
FIG. 5 illustrates the present baffle insert within a sectioned substantially cylindrical cup.

It is also advantageous to taper the pleats 19 radially inward (FIG. 8) from the top end edge 16 to reduce the cross-sectional dimension of the baffle configuration at the bottom end 17*a*. Radial taper along the insert is advantageous in that the resilient baffle, when so formed, is readily adaptable to fit not only within tapered vessels as shown in FIGS. 4, and 7 through 9, but may be resiliently deformed from the tapered configuration to fit within substantially cylindrical vessels as shown in FIG. 5. The baffle can be further deflected to substantially reverse the normal tapered configuration to fit within vessels having a reduced opening and an enlarged chamber below. Throughout these deflections, the pleats remain rigid enough that the substantially discrete cells 20 are maintained axially open for optimal baffling effect of the liquid within the container.

The ribbon material, formed in the pleated configuration enables the insert to be circumferentially and radially compressed as may be noted by comparing FIGS. 1, 3 and 6. The insert 10 may be compressed from the relaxed "memory" state indicated in FIG. 1 to a first configuration which is represented in FIG. 3 as a compressed state in which the baffle insert is readily received within correspondingly "large" vessels 10 as indicated in FIG. 4 and 5. The same baffle insert is further circumferentially compressible to minimize the overall baffle size to facilitate insertion into smaller vessels as indicated in FIG. 6.

It is again noted that the nature of the ribbon and pleats is such that the open cross-sectional character of the insert does not change significantly from the memory form to the smallest usable configuration. A single baffle insert can therefore be produced to fit within an extremely wide variety of vessels having different sizes and shapes. This eliminates one of the problems experienced with prior forms of inserts which were adaptable only for a particular size vessel.

It may be noted in FIGS. 4 through 9 that the axial extent of the present baffle insert may be less than the axial depth dimension of the associated vessel. It is unnecessary that the pleats 19 or the cells 20 produced thereby extend the full axial dimension of the associated vessel. In fact, it is undesirable that the cells extend flush against the bottom of the vessel since it is important that the liquid be relatively freely movable within the vessel bottom.

It may be undesirable to allow relatively free upward axial motion of the present insert 10 within a vessel 11 due to buoyancy by accumulation of bubbles along the ribbon material or by natural buoyancy of the baffle itself. To this end, a number of points 25 may be provided at outward ends of the pleats 19 for pressing engagement against the vessel sidewalls. Points 25 will freely permit downward motion of the baffle within the vessel, but will resist upward motion, especially in styrofoam-type cups where the points will easily anchor in the soft sidewalls of the cup. Of course the points are also aided by frictional engagement of the pleats axially engaging against the side walls of the vessel.

Dispensation of the baffle insert may be accomplished easily from a nested stack. To facilitate nesting, symmetrical baffle configurations similar to those shown in FIGS. 1 through 9, 10 and 12 are preferable.

The nesting capability of the present baffle structure is facilitated through use of means 26 along each baffle insert betwen its top and bottom end edges 16, 17 for the purpose of limiting axial extent of nesting. The successive baffles will nest and may be easily removed from one another. Means 26 may be simply provided in the form of integral tabs formed along the ribbon between the top and bottom end edges 16, 17. The axial distance between the tabs and the top end edges 16 determine the axial dimension separating the successive top end edges 16 of the nested inserts as indicated in FIG. 2.

It is important to note that, for proper effect, the baffle must be placed within a confining opening which is smaller than the cross-sectional size of the baffle insert at its axial center when in its unconfined "memory" form (FIG. 1). It is necessary that the insert be situated within a vessel in such a manner that the pleats 19 press outwardly to yieldably press against the inwardly facing surfaces of the vessel. The baffle insert is thereby braced against the solid structure of the vessel in order to perform its anti-splash function.

The baffling effect is optimized by compressing the baffle sufficiently to almost or completely close off the central axial opening 23 in relation to the adjacent, outward set of cells **20*b*. The optimum baffling effect is realized when the openings between the central opening and the adjacent cells 20*b* are minimized as shown in FIG. 3 or nonexistent as shown in FIG. 6. It is noted the baffle insert will still impart a reduced but substantial baffling effect as long as the discrete cells 20** remain axially open within the vessel. The baffling effect, however, decreases with the increased size of the individual cells and the open communication between the cells and the adjacent open areas within the vessel.

In selecting the baffle size in relation to a given vessel, several considerations may be made. Firstly, the degree of closure for the central opening 23 should be considered once the baffle insert is in place within the vessel. As indicated above, maximum baffling effect is achieved when the central plenum or opening 23 is nearly or completely closed from the outwardly adjacent cells **20*b*, 20*c***.

Another consideration is the ratio of vessel diameter to the central opening 23. The larger the ratio, the better the baffling effect. In other words, more baffling effect is realized with smaller baffle central openings 23 in relation to the vessel opening.

Another consideration is the ratio of the baffle insert height to the container diameter (at the fluid level). Generally speaking, the longer the baffle insert is, the better the effect, with the exception that, as noted above, it is undesirable to have the cells 20 in flush engagement with the container bottom.

Another consideration is the overall degree of closure for the individual cells. Generally speaking, smaller cells will produce a greater baffling effect. This is, of course, within limits in which the cells will not readily discharge the fluid therefrom and therefore frustrate the overall purpose of the vessel in enabling pouring of the fluid therefrom.

Operation of the present invention may be accomplished simply by axially pressing the baffle insert axially downward, bottom end edge first into a vessel. The beveled or inclined edge section may initially cam against the upper lip of the vessel to encourage constriction of the insert to a reduced circumferential size adapted to fit within the vessel. Resiliency of the ribbon, the axial extent of the pleats, and the pointed pleat ends 25 will assure a firm grip between the baffle insert and walls of the vessel.

Only slight compression is required to reduce the insert from the normal, memory form shown in FIG. 1 to the "large" compressed form shown in FIGS. 3 and 4. Further compression is available through the structure described herein to accommodate reception of the insert within even smaller vessels as shown in FIG. 6. It is noted that the cell structure is maintained even in the "small" configuration due to the resilient and somewhat rigid nature of the ribbon material.

The circumferential contractability of the present baffle insert facilitates insertion into cups within a size range as may be typically found in fast food restaurants, for example, in which drinks are served in large 20+ oz., medium 16 oz., and small 6.5 oz. cups. A single size of the present baffle insert will fit each of these three variations without difficulty. It is only necessary that the insert be slightly larger cross-sectionally as noted above in its relaxed memory state than the largest (20+ oz.) vessel.

It is reemphasized that the resilient nature of the ribbon and pleat configuration also facilitates insertion of the baffle insert within different shaped vessels as may be noted by comparing FIGS. 4 and 5. Thus, the same baffle may be used not only as indicated above for a variety of sizes in the same vessel configuration, but may also be utilized with vessels having various shaped openings (which may be noncircular) and unusally shaped fluid chambers. The resilient baffle insert will press itself radially against and conform to a wall or opening rim of nearly any shape vessel.

The baffle insert is preferably axially positioned within the vessel adjacent to the fluid surface. That is not to say the insert must be placed into the vessel after the vessel has been filled with fluid. It is understood that the insert can be placed in the vessel either before or after it is filled with fluid. In fact the insert has been utilized in vessels such as soft drink or beer pitchers and mugs wherein the effervescent liquid was poured after insertion of the baffle. The baffle in this instance, has the effect of reducing foaming action and therefore provides the advantage of reducing the amount of lost beverage due to foaming action in addition to the advantages afforded by its nonspilling-splashing primary effects.

As the fluid level lowers within the vessel, so can the baffle be pressed downwardly, if desired, within the confines of the vessel to maintain the relationship between the fluid surface and the baffle top end edge. This action maintains the optimum aesthetic appearance of the baffle at its interface with the surface of the liquid. However, this is not necessary for optimal baffling effect will increase with the elevational difference between the baffle top edge and the fluid surface below.

Following insertion of the baffle and filling of the vessel, normal usage of the vessel may ensue, with the baffle functioning to severly limit splashing or sloshing of the liquid over the vessel rim.

Baffling action within the associated vessel may be attributable to several features of the present invention. Firstly, the individual cells 20 and the central opening 23 cooperate to divide the overall surface area of the fluid within the vessel into a number of smaller surface areas surrounded or at least partially surrounded by the resilient ribbon. Wave action across the fluid surface is inhibited by the multitude of surfaces which resist such motion. The small waves building within the individual cells are not allowed to accumulate to produce a single surface wave that would normally slosh over the vessel rim. It is also beleived the baffling action may be attributed to resiliency of the baffle. Kinetic energy of the fluid waves is at least partially absorbed by the resilient ribbon which in turn reacts against the walls of the vessel and rebounds in a manner similar to a liquid damped shock absorber. Frictional resistance is also believed to be a factor, with the considerable baffle ribbon surface exposed to the moving fluid. The individual axially elongated cells also tend to directionally channel the fluid, diverting lateral fluid motion to axial motion along the cell lengths, thereby redirecting the otherwise lateral wave action.

The accumulative effect of the above features and quite possibly others that are inherent in the present invention cooperate to produce an extremely effective baffle against fluid motion resulting from lateral shock or sudden motion of the vessel. Yet this advantageous baffling effect has no determinable detrimental effects on normal usage of the vessel. Drinking or pouring from the vessel can be accomplished in the normal manner, by tipping the vesssel until the liquid surface spills over the vessel rim. Drinking or pouring in this manner can continue until the vessel is empty.

Once the baffle has been utilized and the fluid is expended from the vessel, the baffle may be easily removed from the vessel and cleaned. Alternatively, a baffle that is constructed for usage and disposal can be simply disposed of along with the vessel.

In compliance with the statute, the invention has been described in language more or less specific as to structural features. It is to be understood, however, that the invention is not limited to the specific fetures shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A fluid baffle insert for placement within an internal chamber of a vessel, the baffle insert comprising:

a ribbon of a resilient material extending about and axially along a central axis;

pleats formed in said ribbon and extending axially between top and bottom end edges of the ribbon;

wherein the pleats form a prescribed open axial cellular configuration about the central axis along a plane transverse to the central axis;

wherein the ribbon is resiliently radially to permit resilient compression of the baffle for insertion into vessels of various size and shaped internal chambers; and wherein the ribbon includes sufficient rigidity to maintain the prescribed open axial cellular configuration as the ribbon is compressed radially.

2. A fluid baffle insert as claimed by claim 1 wherein the ribbon is continuous and said prescribed open cellular configuration is substantially petaloid.

3. A fluid baffle insert as claimed by claim 2 wherein said petaloid configuration extends axially along the ribbon and forms a substantially concentric network of axially open cells for receiving fluids therein.

4. A fluid baffle insert as claimed by claim 1 wherein said prescribed open cellular configuration defines a central axial opening extending between the top and bottom ribbon end edges and a network of axially open cells situated about the central axial opening.

5. A fluid baffle insert as claimed by claim 1 wherein the ribbon and pleats thereon define a central axial opening and wherein the pleats taper from enlarged folds at the top end edge to reduced folds at the bottom end edge.

6. A fluid baffle insert as claimed by claim 1 wherein said ribbon is continuous about the prescribed open cellular cross-sectional configuration.

7. A fluid baffle insert as claimed by claim 6 wherein the pleats are spaced angularly about the central axis forming angularly spaced axially open cells and a central axial opening surrounded by said cells.

8. A fluid baffle insert as claimed by claim 1 shaped such that a plurality of said baffle inserts may be nested axially within one another; and further comprising means along said ribbon between said top and bottom end edges thereof to limit the axial extent of nesting such that in a nested stack of baffle inserts, the top end edges of successive baffle inserts will be axially spaced from one another.

9. A fluid baffle for an internal chamber of a vessel, the baffle comprising:

a ribbon of resilient material extending about a central axis between axially spaced top and bottom ribbon end edges;

a plurality of pleats formed axially along the ribbon and defining a plurality of axial open fluid receiving cells spaced angularly about the central axis and forming the baffle into a prescribed configuration transverse to said axis;

wherein said ribbon is resilient to permit radial compression of the ribbon with respect to the central axis to effectively reduce a transverse dimension across the baffle;

wherein said resilient ribbon includes sufficient rigidity to substantially maintain the configuration of said fluid receiving cells as the ribbon is compressed.

10. A fluid baffle as claimed by claim 9 wherein said prescribed configuration is substantially petaloid, with said cells having substantially radial petal configurations.

11. A fluid baffle as claimed by claim 10 wherein the petal shaped cells are substantially symmetrical about the central axis.

12. A fluid baffle as claimed by claim 11 wherein said prescribed configuration further comprises a central axial opening from which said petal shaped cells extend substantially radially.

13. A fluid baffle as claimed by claim 9 wherein the pleats are formed to define outward and inward concentric sets of cells spaced angularly about the central axis with the outward set being situated radially outward of and adjacent in the inward set of cells.

14. A fluid baffle for a vessel having a chamber wall as claimed by claim 9 wherein said pleats include curved outward pleat surfaces for tangential engagement with the chamber wall of the vessel, and curved inward pleat surfaces, spaced radially inward of the outward pleat surfaces and defining an axial central opening.

15. A fluid baffle as claimed by claim 14 wherein said pleats define first and second concentric sets of axially open cells spaced angularly about the central axis with an outward set of cells defined at least partially by the outward surfaces and an inward set of cells defined at least partially by the inward surfaces.

16. A fluid baffle as claimed by claim 9 wherein said resilient ribbon tapers from a maximum radial extent in relation to the central axis at the top end edge to a minimum radial extent at the bottom end edge.

17. A fluid baffle as claimed by claim 9 wherein the ribbon is reversible.

18. A fluid baffle as claimed by claim 9 wherein the ribbon is reversible and further comprising a radially inward tapered section along the bottom ribbon end edge forming a substantially pointed bottom end to facilitate insertion of the baffle within a vessel and which, when said ribbon is reversed, tapers radially outward to form a downwardly facing concavity within the baffle.

19. The fluid baffle as claimed by claim 9 wherein the top end edge of the ribbon is formed to produce an axial concavity within the baffle.

20. The fluid baffle insert as claimed by claim 9 wherein said ribbon is capable of resilient radial contraction or expansion at one of the end edges independently of radial expansion or contraction at the other end edge.

21. The fluid baffle as claimed by claim 9 wherein the axial cells are arranged in substantially random array about the central axis.

22. The fluid baffle as claimed by claim 9 wherein the cells include curvilinear configurations in transverse cross-section relative to the central axis.

23. The fluid baffle as claimed by claim 9 wherein the cells include rectilinear configurations in transverse cross-section relative to the central axis.

24. The fluid baffle as claimed by claim 9 wherein the cells include rectilinear and curvilinear configurations in transverse cross-section relative to the central axis.

* * * * *